US011376707B2

(12) United States Patent
Suzuki

(10) Patent No.: US 11,376,707 B2
(45) Date of Patent: Jul. 5, 2022

(54) GRINDING METHOD

(71) Applicant: DISCO CORPORATION, Tokyo (JP)

(72) Inventor: Yoshikazu Suzuki, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 30 days.

(21) Appl. No.: 17/182,833

(22) Filed: Feb. 23, 2021

(65) Prior Publication Data

US 2021/0291316 A1 Sep. 23, 2021

(30) Foreign Application Priority Data

Mar. 17, 2020 (JP) ..... JP2020-045924

(51) Int. Cl.
*B24B 41/04* (2006.01)
*B24B 1/00* (2006.01)

(52) U.S. Cl.
CPC ..... *B24B 41/04* (2013.01); *B24B 1/00* (2013.01)

(58) Field of Classification Search
CPC .. B24B 41/04; B24B 1/00; B24B 7/22; B24B 7/228; B24B 37/005; B24B 37/013; B24B 37/04; B24B 37/042; B24B 37/046; B24B 37/10; B24B 37/105; B24B 37/107; B24B 37/30; B24B 37/34; B24B 49/02; B24B 49/04; B24B 49/045; B24B 49/10; B24B 49/12; B24B 27/0046
See application file for complete search history.

(56) References Cited

U.S. PATENT DOCUMENTS

2014/0183163 A1* 7/2014 Sugiya ..... B24B 1/00 216/52
2018/0076016 A1* 3/2018 Nishihara ..... B24B 37/042
2019/0111537 A1* 4/2019 Kakefuda ..... B24B 57/02

FOREIGN PATENT DOCUMENTS

JP 2007019461 A 1/2007

* cited by examiner

*Primary Examiner* — Joel D Crandall
*Assistant Examiner* — Sidney D Hohl
(74) *Attorney, Agent, or Firm* — Greer Burns & Crain Ltd.

(57) ABSTRACT

A grinding method includes an oblique grinding step of rotating a grinding wheel about the central axis of a second shaft, tilting the second shaft to a first shaft of a rotatable chuck table such that the bottom of a first portion of the grinding wheel that is positioned above an outer circumferential portion of the chuck table is higher than the bottom of a second portion of the grinding wheel that is positioned above a central portion of the chuck table, and then moving the grinding wheel and the chuck table relatively closer to each other along a direction parallel to the first shaft, thereby forming a disk-shaped recess in the reverse side of the workpiece, and a tilt changing and grinding step of grinding the reverse side of the workpiece while gradually changing a tilt of the second shaft to orient parallel to the first shaft.

2 Claims, 8 Drawing Sheets

GRINDING METHOD

BACKGROUND OF THE INVENTION

Field of the Invention

The present invention relates to a grinding method for grinding a central portion of a reverse side of a workpiece to form in the reverse side of the workpiece a disk-shaped recess including a circular portion that has been ground and a ring-shaped stiffening portion that has been unground which surrounds the periphery of the circular ground portion.

Description of the Related Art

Workpieces having a plurality of areas demarcated on a face side thereof by a grid of projected dicing lines and a plurality of devices such as integrated circuits (ICs), or large-scale-integration (LSI) circuits formed in the respective areas are divided into a plurality of device chips by a grinding step, a cutting process, and so on. One method of grinding a workpiece grinds only a circular central portion of the reverse side of the workpiece that is aligned thicknesswise across the workpiece with a circular device region of the face side of the workpiece where a plurality of devices are disposed (see, for example, Japanese Patent Laid-open No. 2007-19461). When only the circular central portion of the reverse side of the workpiece is ground, there is formed in the reverse side a disk-shaped recess defined by a circular portion that has been ground and a ring-shaped stiffening portion that has been unground which surrounds the periphery of the circular ground portion. The ring-shaped stiffening portion that is left unground on the reverse side allows the workpiece to be handled, e.g., to be transported, with ease even though the reverse side of the workpiece has been thinned down.

SUMMARY OF THE INVENTION

However, in the grinding step, a number of chippings tend to be produced on the reverse side of the ring-shaped stiffening portion, lowering its own mechanical strength, due to an impact of grindstones contacting the reverse side of a workpiece and outer side faces of the grindstones contacting an inner circumferential side face of the ring-shaped stiffening portion. Furthermore, in a case where the workpiece is processed by wet etching after the grinding step, the areas of the ring-shaped stiffening portion where the chippings have been formed are etched, forming surface irregularities on the reverse side of the ring-shaped stiffening portion. The surface irregularities thus formed are likely to cause other problems in subsequent processes. For example, a metal film evaporated on the reverse side of the ring-shaped stiffening portion is liable to be peeled off from the surface irregularities that act as peel initiating points. Moreover, when a dicing tape is affixed to the reverse side of the workpiece, the dicing tape is likely to fail to be affixed properly to the workpiece on account of the surface irregularities. The present invention has been made in view of the above-described problems. It is an object of the present invention to provide a grinding method for grinding a workpiece while reducing the number of chippings produced on the reverse side of a ring-shaped stiffening portion of the workpiece.

In accordance with an aspect of the present invention, there is provided a grinding method of grinding a reverse side of a disk-shaped workpiece having on a face side thereof a device region where a plurality of devices are formed and an outer circumferential surplus region surrounding the device region, with a grinding stone part of a grinding wheel having an annular wheel base, the grinding stone part being disposed in an annular pattern on a surface of the wheel base. The grinding method includes a face side protecting step of covering the face side of the workpiece with a protective member, a holding step of holding the face side of the workpiece under suction on a disk-shaped chuck table that is rotatable about a central axis of a first rotational shaft, after the holding step, an oblique grinding step of rotating the grinding wheel about the central axis of a second rotational shaft, the grinding wheel being mounted on the lower end of a second rotational shaft, having a diameter smaller than the diameter of the chuck table, and disposed above the chuck table, tilting the second rotational shaft with respect to the first rotational shaft such that the bottom of a first portion of the grinding wheel that is positioned above an outer circumferential portion of the chuck table is higher than the bottom of a second portion of the grinding wheel that is positioned above a central portion of the chuck table, and then moving the grinding wheel and the chuck table relatively to each other to bring the grinding wheel and the chuck table closer to each other along a direction parallel to the first rotational shaft, thereby forming a disk-shaped recess in the reverse side of the workpiece by grinding a central portion of the reverse side of the workpiece that corresponds to the device region thicknesswise across the workpiece, the disk-shaped recess being defined by a circular ground portion and a ring-shaped stiffening portion surrounding the circular ground portion and left unground, and after the oblique grinding step, a tilt changing and grinding step of grinding the reverse side of the workpiece while gradually changing a tilt of the second rotational shaft to orient the second rotational shaft parallel to the first rotational shaft.

Preferably, the method may further include after the tilt changing and grinding step, an ordinary grinding step of orienting the second rotational shaft of the grinding wheel and the first rotational shaft of the chuck table parallel to each other and then moving the grinding wheel and the chuck table relatively to each other to bring the grinding wheel and the chuck table closer to each other along the direction parallel to the first rotational shaft, thereby grinding the circular ground portion.

According to the aspect of the present invention, in the oblique grinding step, the grinding wheel is rotated about the central axis of the second rotational shaft, the second rotational shaft is tilted with respect to the first rotational shaft such that the bottom of the first portion of the grinding wheel that is positioned above the outer circumferential portion of the chuck table is higher than the bottom of the second portion of the grinding wheel that is positioned above the central portion of the chuck table, and then the disk-shaped recess is formed in the reverse side of the workpiece by grinding the central portion of the reverse side of the workpiece. In this manner, the ring-shaped stiffening portion on the reverse side is prevented from producing chippings that would be otherwise formed due to contact between the outer side surfaces of the grindstones and the inner circumferential edge of the upper surface of the ring-shaped stiffening portion. Consequently, the number of chippings that may be formed on the reverse side of the ring-shaped stiffening portion is minimized.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
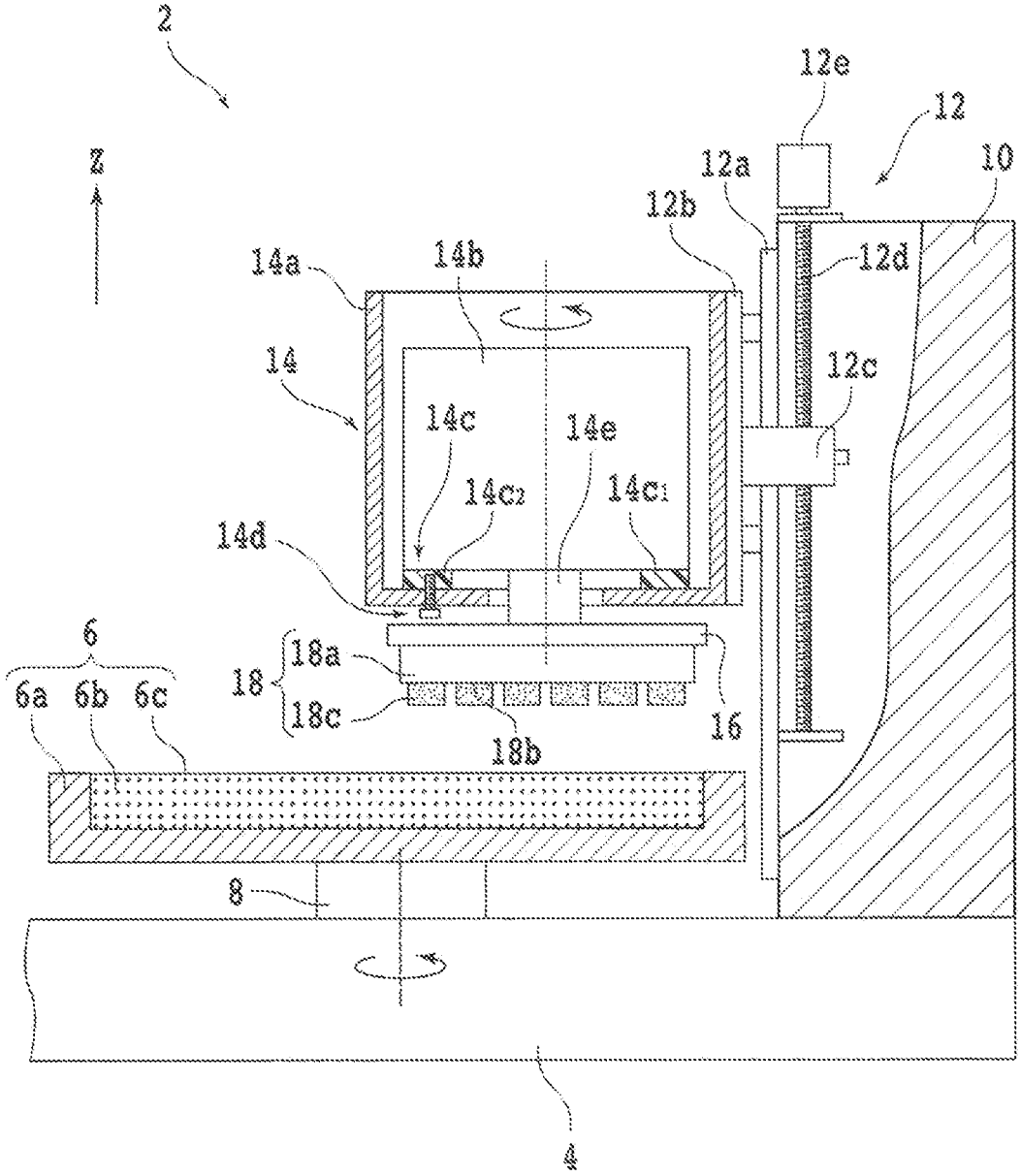
FIG. 1 is a side elevational view, partly in cross section, of a grinding apparatus on which a grinding method according to an embodiment of the present invention is carried out.

A grinding method according to an embodiment of the present invention will be described in detail below with reference to the accompanying drawings. First, a grinding apparatus 2 on which the grinding method is carried out will be described below with reference to FIG. 1. FIG. 1 is a side elevational view, partly in cross section, of the grinding apparatus 2. As illustrated in FIG. 1, the grinding apparatus 2 has a base 4 substantially in the form of a rectangular parallelepiped supporting a plurality of components of the grinding apparatus 2 thereon. A disk-shaped chuck table 6 is rotatably mounted on the base 4. The chuck table 6 has a frame 6*a* made of ceramic that has a fluid channel, not illustrated, defined therein. The fluid channel has an end connected to a suction source, not illustrated, such as an ejector.

The frame 6*a* has a recess defined as a disk-shaped space in an upper surface thereof. A disk-shaped porous plate 6*b* is fixedly disposed in the recess. Note that the diameter of the recess and the porous plate 6*b* is substantially the same as the diameter of a workpiece 11 (see FIG. 2) to be described later, and may be 200 mm, for example. The fluid channel defined in the frame 6*a* has the other end connected to the porous plate 6*b*. When the suction source is actuated, it generates and transmits a vacuum through the fluid channel and acts on the upper surface of the porous plate 6*b*, which thus functions as a holding surface 6*c* for holding the workpiece 11 under suction thereon.

A first rotary actuator, not illustrated, such as an electric motor is disposed in the base 4 below the lower surface of the chuck table 6. The first rotary actuator has an output shaft, i.e., a first rotational shaft, 8 extending substantially parallel to a Z-axis direction, i.e., a heightwise direction or vertical direction. The output shaft 8 is coupled to the lower surface of the chuck table 6. When the first rotary actuator is energized, it rotates the output shaft 8 about its central axis, rotating the chuck table 6 about its central axis, i.e., the central axis of the output shaft 8. A column 10 in the form of a rectangular parallelepiped is erected on a rear area of the base 4 behind the chuck table 6.

A grinding feed unit 12 is disposed in a front portion of the column 10. The grinding feed unit 12 has a pair of guide rails 12*a* extending substantially parallel to the heightwise direction and fixed to a front side surface of the column 10. Note that, in FIG. 1, one of the guide rails 12*a* that is remoter from the viewer of FIG. 1 is illustrated and the other guide rail 12*a* closer to the viewer is omitted from illustration. A movable plate 12*b* is slidably mounted on the guide rails 12*a*. A nut 12*c* is mounted on a reverse side, i.e., a rear surface, of the movable plate 12*b* and operatively threaded over a ball screw 12*d* disposed in the column 10 and extending substantially parallel to the heightwise direction. The ball screw 12*d* is rotatable about its central axis.

The ball screw 12*d* has an upper end coupled to a stepping motor 12*e*. When the stepping motor 12*e* is energized, it rotates the ball screw 12*d* about its central axis, causing the nut 12*c* to move the movable plate 12*b* along the guide rails 12*a*. A grinding unit 14 includes a tubular holder 14*a* fixedly mounted on a face side, i.e., a front surface, of the movable plate 12*b*. The holder 14*a* houses a tubular spindle housing 14*b* disposed in an inner space thereof.

An annular array of spacers 14*c* (14$c_1$, 14$c_2$) each shaped as a block is disposed on the lower surface of the spindle housing 14*b*. Each of the spacers 14*c* has an upper surface held in contact with the lower surface of the spindle housing 14*b* and a lower surface disposed on the upper surface of a bottom plate of the holder 14*a*. In FIG. 1, one of the spacers 14*c* that is disposed in a position closest to the column 10 is illustrated as a spacer 14$c_1$, and another one of the spacers 14*c* that is disposed in a position remotest from the column 10 is illustrated as a spacer 14$c_2$. The spacer 14$c_2$ has an internally threaded hole defined in a lower portion thereof.

The bottom plate of the holder 14*a* has a through hole defined therein that is positioned below the internally threaded hole in the spacer 14$c_2$ in alignment therewith. A screw 14*d* has an externally threaded shank operatively threaded through the through hole in the bottom plate of the holder 14*a* into the internally threaded hole in the spacer 14$c_2$. The screw 14*d* has a head exposed below the bottom plate of the holder 14*a* and coupled to the output shaft of an actuating mechanism, not illustrated, such as an electric motor. When the actuating mechanism is energized to rotate the screw 14*d* in one direction about its central axis, the spacer 14$c_2$ moves upwardly, spacing its lower surface slightly away from the upper surface of the bottom plate of the holder 14*a*. When the actuating mechanism is energized to rotate the screw 14*d* in the opposite direction about its central axis, the spacer 14$c_2$ moves downwardly, bringing its lower surface into contact with the upper surface of the bottom plate of the holder 14*a*. The thickness of the spacer 14$c_2$, the distance that the spacer 14$c_2$ moves, etc. are appropriately adjusted to realize the grinding method for the workpiece 11 as described later.

The spindle housing 14*b* houses a cylindrical spindle, i.e., a second rotational shaft, 14*e* therein. The spindle 14*e* is rotatably supported in the spindle housing 14*b*. The spindle 14*e* has an upper end coupled to a second rotary actuator, not illustrated, such as an electric motor, disposed in the spindle housing 14*b*. The spindle 14*e* extends downwardly from the spindle housing 14*b* and through an opening defined centrally in the bottom plate of the holder 14*a*. The spindle 14*e* has a lower end positioned below the lower surface of the bottom plate of the holder 14*a* and coupled to a central portion of the upper surface of a disk-shaped wheel mount 16.

The wheel mount 16 has a lower surface on which the upper surface of an annular wheel base 18*a* made of aluminum alloy or the like is mounted. In other words, the wheel base 18*a* is mounted on the lower end of the spindle 14*e* through the wheel mount 16. The wheel base 18*a* is disposed above the chuck table 6. The diameter of the wheel base 18*a* is smaller than the diameter of the chuck table 6. For example, the diameter of the wheel base 18*a* is set to a predetermined length smaller than the diameter of the holding surface 6*c* that is approximately 200 mm according to the present embodiment.

The wheel base 18*a* has a lower surface, i.e., a surface, 18*b* on which a plurality of grindstones 18*c* each shaped as a block, i.e., a grinding stone part, are disposed in an annular pattern referred to as a segment array. Alternatively, a single annular grindstone, i.e., a grinding stone part, rather than the plurality of grindstones 18*c* may be disposed on the lower surface of the wheel base 18*a* in a pattern referred to as a continuous array. The wheel base 18*a* and the grindstones 18*c* are jointly included in a grinding wheel 18. When the second rotary actuator is energized, it rotates the spindle 14*e* about its central axis, rotating the grinding wheel 18 about the central axis of the spindle 14*e* as the second rotational shaft. The spindle 14*e* and the wheel base 18*a* have a fluid channel, not illustrated, defined therein for supplying a grinding fluid such as pure water therethrough to the grindstones 18*c*. During a grinding step, the grinding fluid is supplied from a grinding fluid supply source, not illustrated, through the fluid channel to the grindstones 18*c*.

Figure 2:
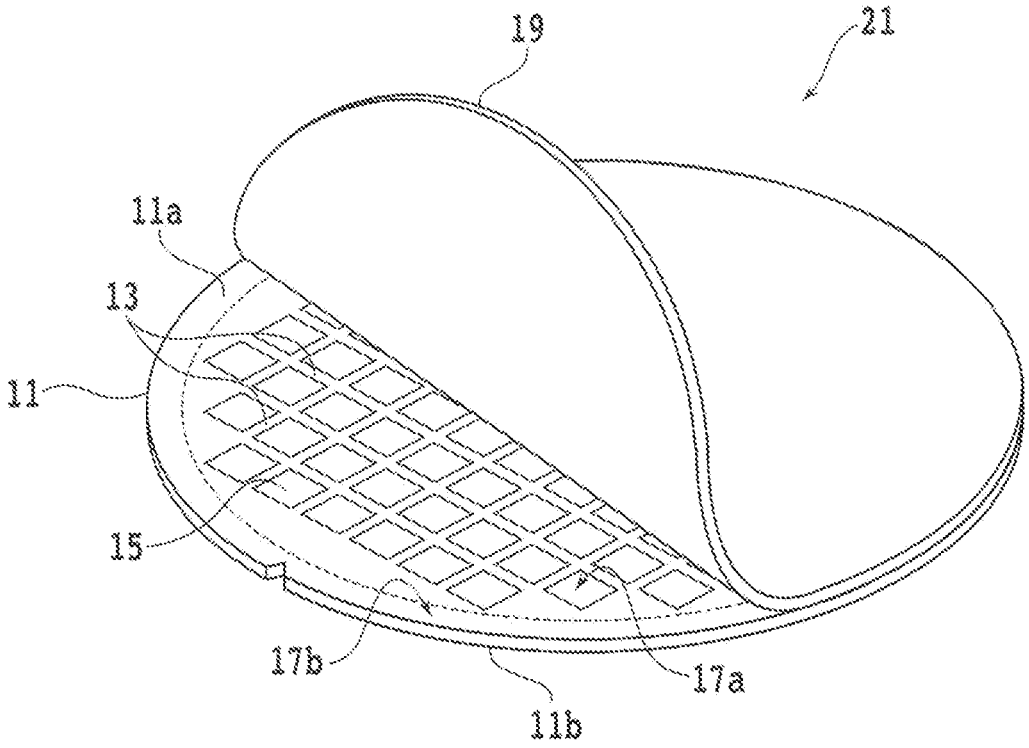
FIG. 2 is a perspective view of a workpiece with a protective member affixed thereto.

Next, the workpiece 11 to be ground by the grinding unit 14 will be described below. FIG. 2 illustrates the workpiece 11 and a protective member 19 in perspective. The workpiece 11 according to the present embodiment includes a disk-shaped wafer made of a semiconductor material such as silicon, for example. The workpiece 11 has a predetermined thickness ranging from 100 to 800 μm, for example. The workpiece 11 has a face side 11*a* having a plurality of areas demarcated by a grid of projected dicing lines or streets 13 and a plurality of devices 15 such as ICs, or LSI circuits, each of the plurality of devices 15 being formed in the respective areas. The workpiece 11 is not limited to any materials, shapes, structures, sizes, and so on. For example, a substrate made of a semiconductor material other than silicon may be used as the workpiece 11. The devices 15 are similarly not limited to any kinds, numbers, shapes, structures, sizes, and so on.

On the face side 11*a* of the workpiece 11, the devices 15 are disposed within a circular device region 17*a* thereof. The device region 17*a* is surrounded by an annular outer circumferential surplus region 17*b* in which the devices 15 are not disposed lying on the outer side of the device region 17*a*. In FIG. 2, the boundary between the circular device region 17*a* and the annular outer circumferential surplus region 17*b* is indicated by a broken line. The boundary represents a hypothetical line and is not actually applied as a visible line to the workpiece 11. The face side 11*a* and a reverse side 11*b* opposite the face side 11*a* have their outer circumferential edges whose corners are beveled as illustrated in FIGS. 3A through 6.

Figure 6:
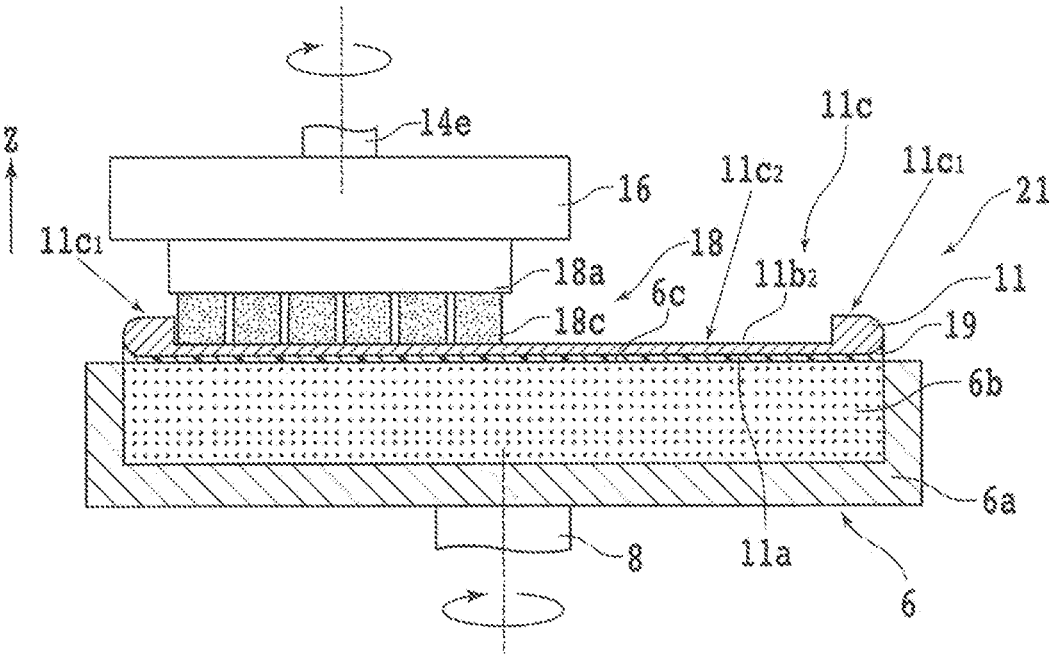
FIG. 6 is a side elevational view, partly in cross section, illustrating an ordinary grinding step.
Figure 7:
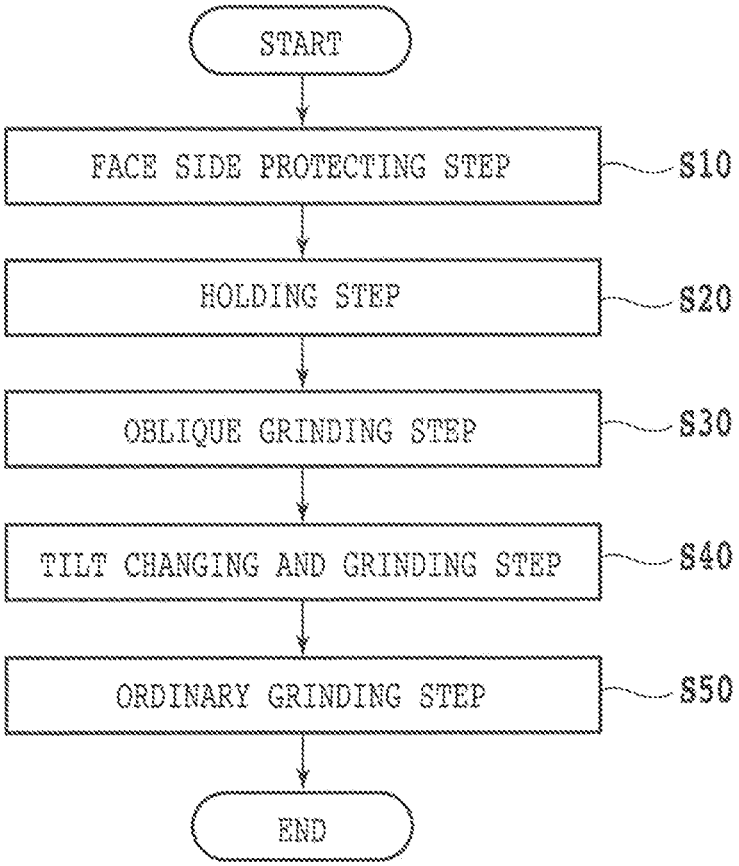
FIG. 7 is a flowchart of the sequence of the grinding method.

The grinding method for grinding the workpiece 11 will be described below with reference to FIGS. 2 through 7. FIG. 7 is a flowchart of the sequence of the grinding method. First, as illustrated in FIG. 2, a circular protective member 19 made of resin is affixed to the face side 11*a* of the workpiece 11. The workpiece 11 and the protective member 19 that covers the face side 11*a* thereof are jointly included in a workpiece unit 21 (a face side protecting step S10 illustrated in FIG. 7). The protective member 19 is affixed to the workpiece 11 in covering relation to the beveled corner of the outer circumferential edge of the face side 11*a* as well as the face side 11*a* itself. The protective member 19 includes a disk-shaped sheet of resin and has a base layer and a glue layer, i.e., an adhesive layer, disposed on one surface of the base layer. The glue layer is made of ultraviolet-curable resin, though it may be made of thermosetting rein or naturally curable resin. Note that the base layer may not necessarily include a glue layer. For example, the protective member 19 may have a base layer only and may be affixed to the face side 11*a* by thermocompression, for example.

Figure 3A:
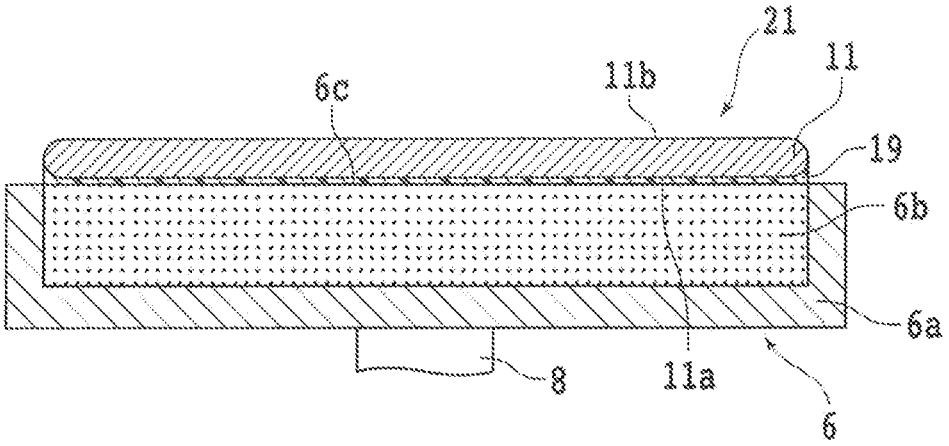
FIG. 3A is a side elevational view, partly in cross section, of a workpiece unit placed on a chuck table.

After the face side protecting step S10, the holding surface 6*c* of the chuck table 6 holds the face side 11*a* of the workpiece 11, or specifically the surface of the protective member 19 that is opposite the surface thereof affixed to the face side 11*a* of the workpiece 11, under suction thereon (a holding step S20). FIG. 3A is a side elevational view, partly in cross section, of the workpiece unit 21 placed on the chuck table 6. After the holding step S20, the grinding wheel 18 of the grinding apparatus 2 grinds the reverse side 11*b* of the workpiece 11 on the chuck table 6. Specifically, according to the present embodiment, first, the actuating mechanism that is coupled to the screw 14*d* is energized to rotate the screw 14*d* about its central axis for thereby adjusting the position of the spacer $\mathbf{14}c_2$.

Figure 3B:
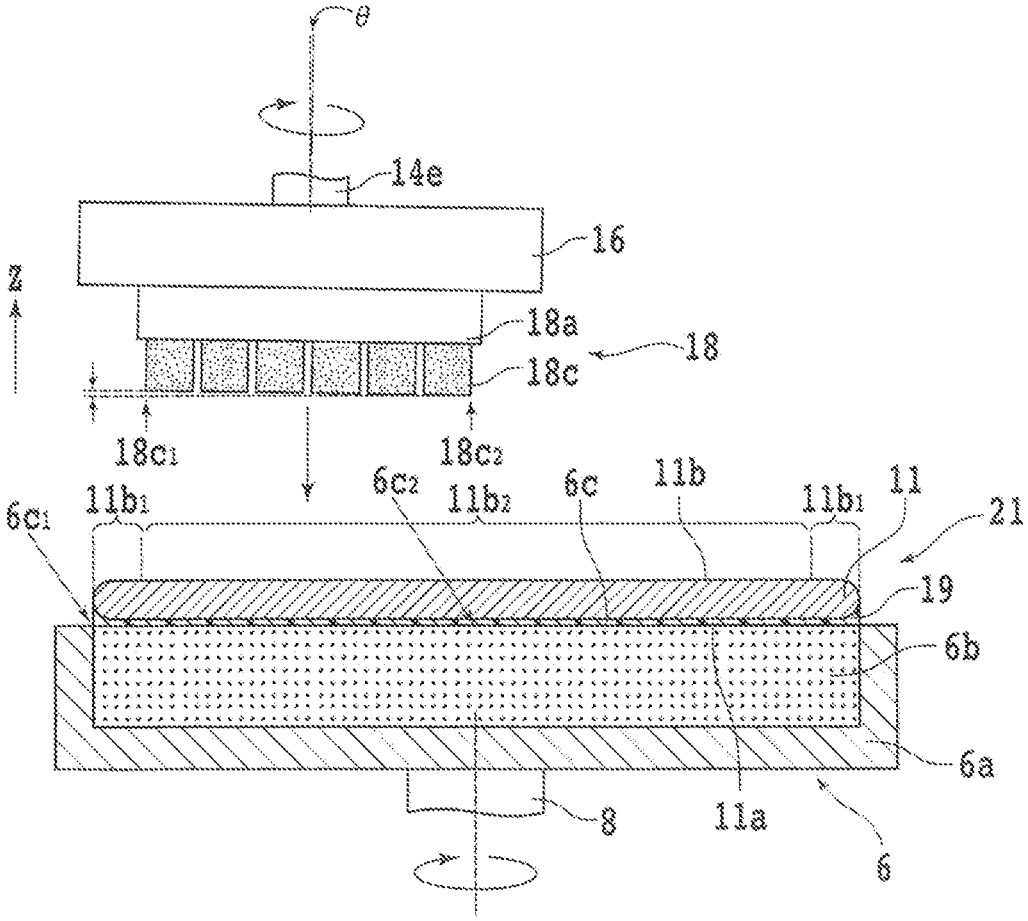
FIG. 3B is a side elevational view, partly in cross section, of a grinding wheel, the workpiece unit, and the chuck table in an oblique grinding step.

As illustrated in FIG. 3B, the lower end of the spindle 14*e* is positioned between an outer circumferential portion $\mathbf{6}c_1$ of the holding surface 6*c* and a central portion $\mathbf{6}c_2$ of the holding surface 6*c*. The spacer $\mathbf{14}c_2$ is positionally adjusted by the actuating mechanism to tilt the spindle 14*e* through a predetermined angle θ from the vertical direction toward the central portion $\mathbf{6}c_2$ of the holding surface 6*c*. The predetermined angle θ, represented by an arc degree, is in a range larger than 0 arc degree and equal to or smaller than 2 arc degrees, i.e., 0 arc degree $<\theta\leq 2$ arc degrees. As illustrated in FIG. 3B, by tilting the spindle 14*e* whose central axis is indicated by the dot-and-dash line through the predetermined angle θ from a straight line extending in the vertical direction parallel to the output shaft 8 as indicated by the broken line, the bottom of a first portion $\mathbf{18}c_1$ of the grindstones 18*c* that is positioned above the outer circumferential portion $\mathbf{6}c_1$ of the holding surface 6*c* becomes slightly higher than the bottom of a second portion $\mathbf{18}c_2$ of the grindstones 18*c* that is positioned above the central portion $\mathbf{6}c_2$ of the holding surface 6*c*. Then, the spindle 14*e* is rotated to rotate the grinding wheel 18 about the central axis of the spindle 14*e*, and the output shaft 8 is rotated to rotate the chuck table 6 about the central axis of the output shaft 8. For example, the spindle 14*e* is rotated at a rotational speed of 3000 rpm and the output shaft 8 is rotated at a rotational speed of 300 rpm.

Then, the stepping motor 12*e* is energized to move the grinding wheel 18 and the chuck table 6 relatively to each other in a direction parallel to the output shaft 8 in order to bring the grinding wheel 18 and the chuck table 6 closer to each other. For example, the grinding unit 14 is grounding-fed downwardly along the Z-axis direction at a speed of 1.0 μm/second. The grindstones 18*c* of the grinding wheel 18 are brought into grinding contact with the reverse side 11*b* of the workpiece 11, thereby grinding the reverse side 11*b* (an oblique grinding step S30). FIG. 3B is a side elevational view, partly in cross section, of the grinding wheel 18, the workpiece unit 21, and the chuck table 6 in the oblique grinding step S30.

Figure 4A:
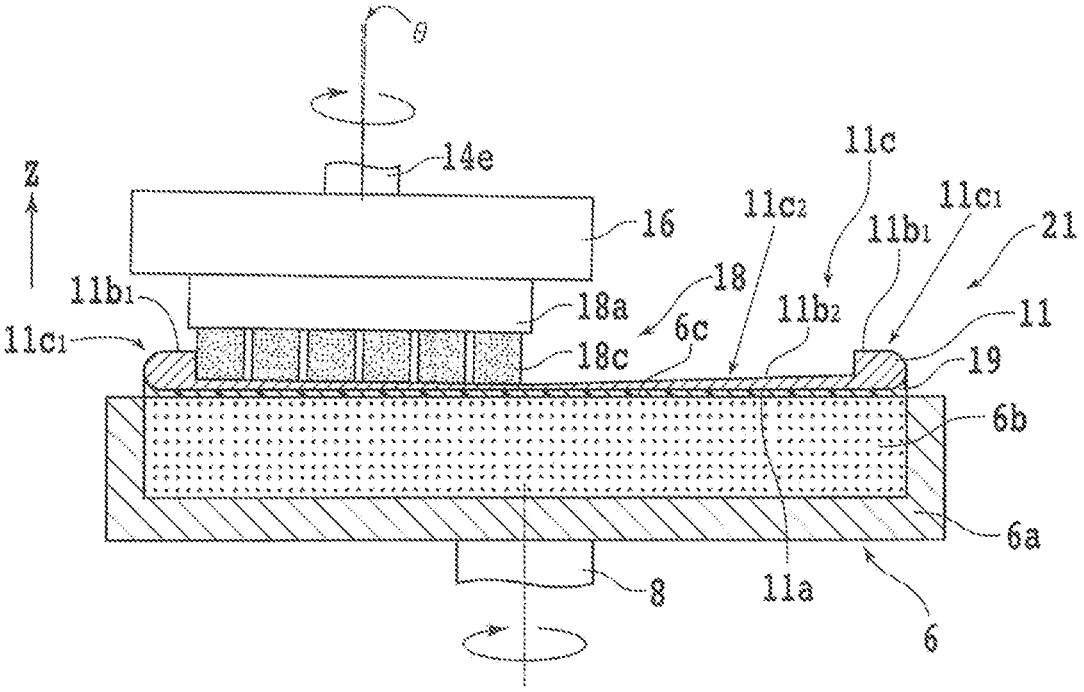
FIG. 4A is a side elevational view, partly in cross section, of a grinding wheel, the workpiece unit, and the chuck table at the time the grinding wheel is grinding the workpiece.

When the grindstones 18*c* contact the reverse side 11*b* of the workpiece 11, the grindstones 18*c* grind the reverse side 11*b* and removes part of the reverse side 11*b*. According to the present embodiment, the grindstones 18*c* do not grind an outer circumferential portion $\mathbf{11}b_1$ of the reverse side 11*b* that corresponds to the outer circumferential surplus region 17*b* but grind a central portion $\mathbf{11}b_2$ of the reverse side 11*b* that corresponds to the device region 17*a* thicknesswise across the workpiece 11. FIG. 4A is a side elevational view, partly in cross section, of the grinding wheel 18, the workpiece unit 21, and the chuck table 6 at the time the grinding wheel 18 is grinding the workpiece 11. The central portion $\mathbf{11}b_2$ is ground into a circular ground portion $\mathbf{11}c_2$ by the grindstones 18*c*. The ground portion $\mathbf{11}c_2$ is surrounded by the outer circumferential portion $\mathbf{11}b_1$ disposed therearound that is left unground as a ring-shaped stiffening portion $\mathbf{11}c_1$.

Figure 4B:
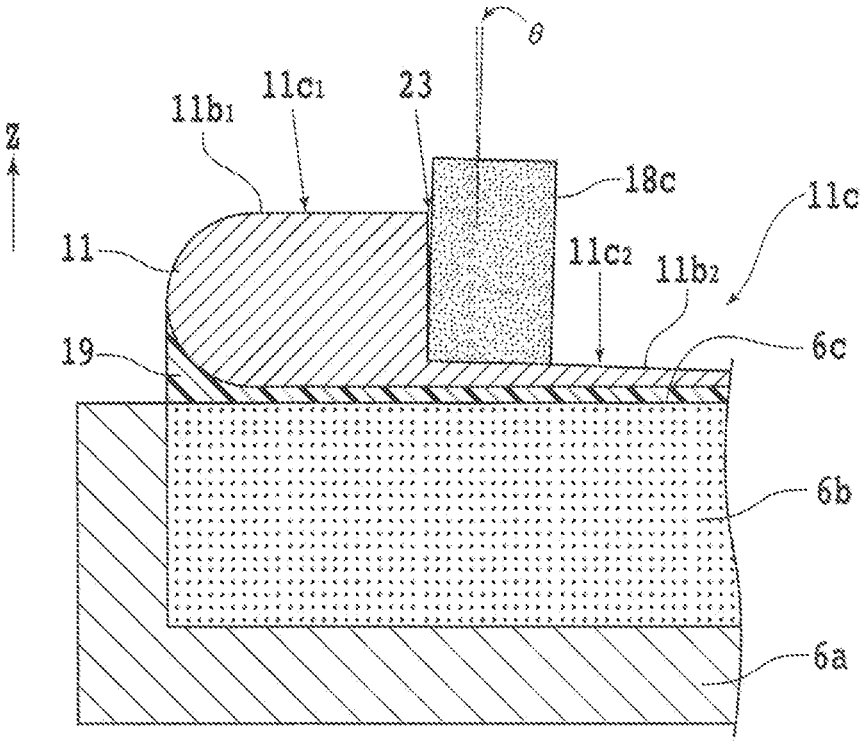
FIG. 4B is an enlarged fragmentary side elevational view, partly in cross section, of a portion of the assembly illustrated in FIG. 4A.

The ground portion $\mathbf{11}c_2$ and the ring-shaped stiffening portion $\mathbf{11}c_1$ that surrounds the ground portion $\mathbf{11}c_2$ define a disk-shaped recess 11*c* centrally in the reverse side lib of the workpiece 11. FIG. 4B is an enlarged fragmentary side elevational view, partly in cross section, of a portion of the assembly illustrated in FIG. 4A in the vicinity of the boundary between the ground portion $\mathbf{11}c_2$ and the ring-shaped stiffening portion $\mathbf{11}c_1$. In the oblique grinding step S30, the spindle 14*e* is tilted the predetermined angle θ with respect to the output shaft 8. Therefore, the grindstones 18*c* grind the reverse side lib while the grindstones 18*c* are having their outer side surfaces spaced from an inner circumferential edge of the upper surface of the ring-shaped stiffening portion $\mathbf{11}c_1$, i.e., the outer circumferential portion $\mathbf{11}b_1$ of the reverse side lib. In other words, when the grindstones 18*c* grind the reverse side lib, a gap 23 is defined between the outer side surfaces of the grindstones 18*c* and the inner circumferential edge of the upper surface of the ring-shaped stiffening portion $\mathbf{11}c_1$.

For example, providing the ring-shaped stiffening portion $\mathbf{11}c_1$ has an inner circumferential side surface that is 600 μm deep along the Z-axis direction, if 0=1.9 degrees, then the outer side surfaces of the grindstones 18*c* are spaced from the inner circumferential edge of the upper surface of the ring-shaped stiffening portion $\mathbf{11}c_1$ by a distance of 20 μm. Consequently, in a case where the abrasive grains on the outer side surfaces of the grindstones 18*c* protrude therefrom by a distance of 10 μm, the abrasive grains on the outer side surfaces of the grindstones 18*c* are kept out of contact with the inner circumferential edge of the upper surface of the ring-shaped stiffening portion $\mathbf{11}c_1$. Since the gap 23 is thus defined in the oblique grinding step S30 according to the present embodiment, the ring-shaped stiffening portion $\mathbf{11}c_1$ on the reverse side 11*b* is prevented from producing chippings that would be otherwise formed due to contact between the outer side surfaces of the grindstones 18*c* and the inner circumferential edge of the upper surface of the ring-shaped stiffening portion $\mathbf{11}c_1$. Consequently, the number of chippings that may be formed on the reverse side of the ring-shaped stiffening portion $\mathbf{11}c_1$ is minimized.

After the oblique grinding step S30, the grinding unit 14 stops being grinding-fed, and the actuating mechanism is energized to rotate the screw 14*d* in the opposite direction about its central axis, thereby gradually changing the tilt of the spindle 14*e* in a direction opposite the direction in which the spindle 14*e* is tilted in the oblique grinding step S30. According to the present embodiment, the tilt of the spindle 14*e* is adjusted in order to cancel out the predetermined angle θ formed in the oblique grinding step S30, orienting the spindle 14*e* parallel to the output shaft 8. While the tilt of the spindle 14*e* is changing, the grindstones 18*c* continue to grind the reverse side lib of the workpiece 11 (a tilt changing and grinding step S40).

Figure 5:
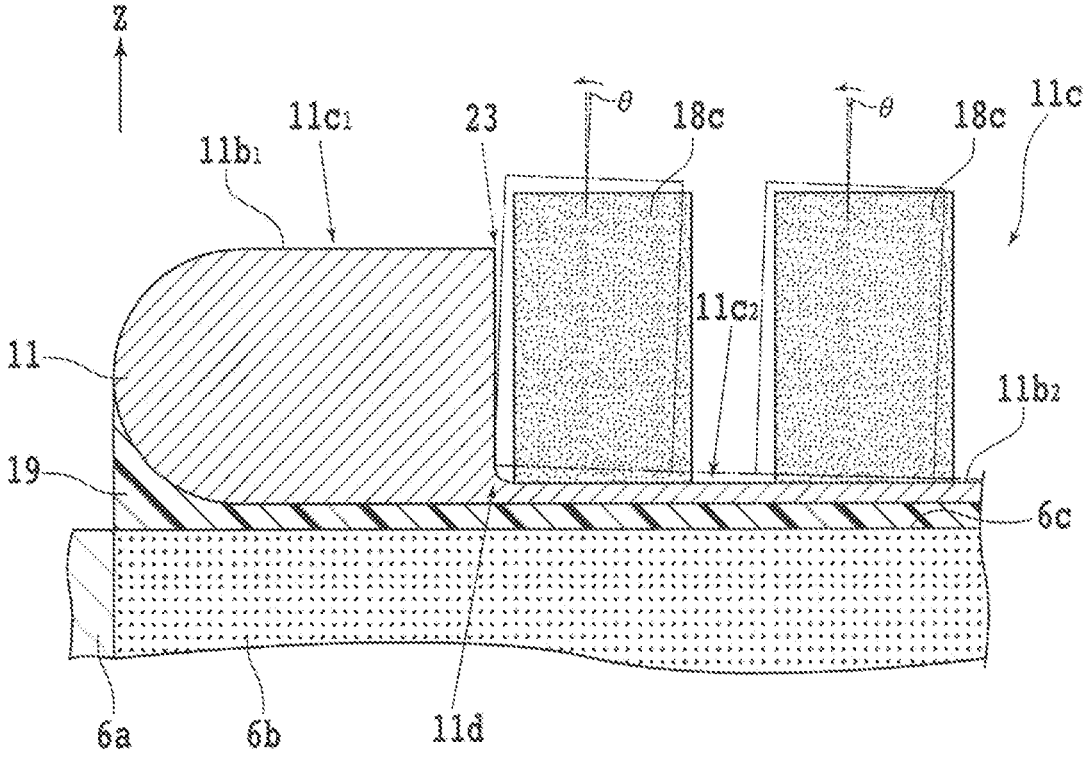
FIG. 5 is an enlarged fragmentary side elevational view, partly in cross section, illustrating a tilt changing and grinding step.

FIG. 5 is an enlarged fragmentary side elevational view, partly in cross section, of a portion of the assembly in the vicinity of the boundary between the ground portion $\mathbf{11}c_2$ and the ring-shaped stiffening portion $\mathbf{11}c_1$, illustrating the tilt changing and grinding step S40. Note that, in FIG. 5, the grindstones 18*c* that are tilted in the oblique grinding step S30 are indicated by the two-dot-and-dash lines, whereas the grindstones 18*c* whose tilt is eliminated in the tilt changing and grinding step S40 are indicated by the solid lines. Note that, in the tilt changing and grinding step S40, as the spindle 14*e* is brought parallel to the output shaft 8, the ground portion $\mathbf{11}c_2$ is made flatter than if the grinding step is finished in the oblique grinding step S30. In the tilt changing and grinding step S40, an annular curved surface 11*d* is formed in the vicinity of the boundary between the bottom of the inner circumferential side surface of the ring-shaped stiffening portion $\mathbf{11}c_1$ and the ground portion $\mathbf{11}c_2$.

In the tilt changing and grinding step S40 according to the present embodiment, the grinding unit 14 is not grinding-fed downwardly. However, the spindle 14*e* may be oriented parallel to the output shaft 8 while grinding-feeding the grinding unit 14 at a speed of 1.0 μm/second. After the tilt changing and grinding step S40, with the spindle 14*e* and the output shaft 8 lying parallel to each other, the ground portion $\mathbf{11}c_2$ is further ground by the grindstones 18*c* (an ordinary grinding step S50). FIG. 6 is a side elevational view, partly in cross section, illustrating the ordinary grinding step S50.

In the ordinary grinding step S50, the grinding wheel 18 and the chuck table 6 are moved relatively to each other in order to bring the grinding wheel 18 and the chuck table 6 closer to each other in a direction parallel to the output shaft 8. For example, the grinding unit 14 is grounding-fed downwardly at a speed of 1.0 μm/second. Note that, in the grinding method according to the present embodiment, the ordinary grinding step S50 is not an indispensable step. Stated otherwise, the grinding of the workpiece 11 may be finished when the steps from the face side protecting step S10 to the tilt changing and grinding step S40 are carried out.

Figure 8:
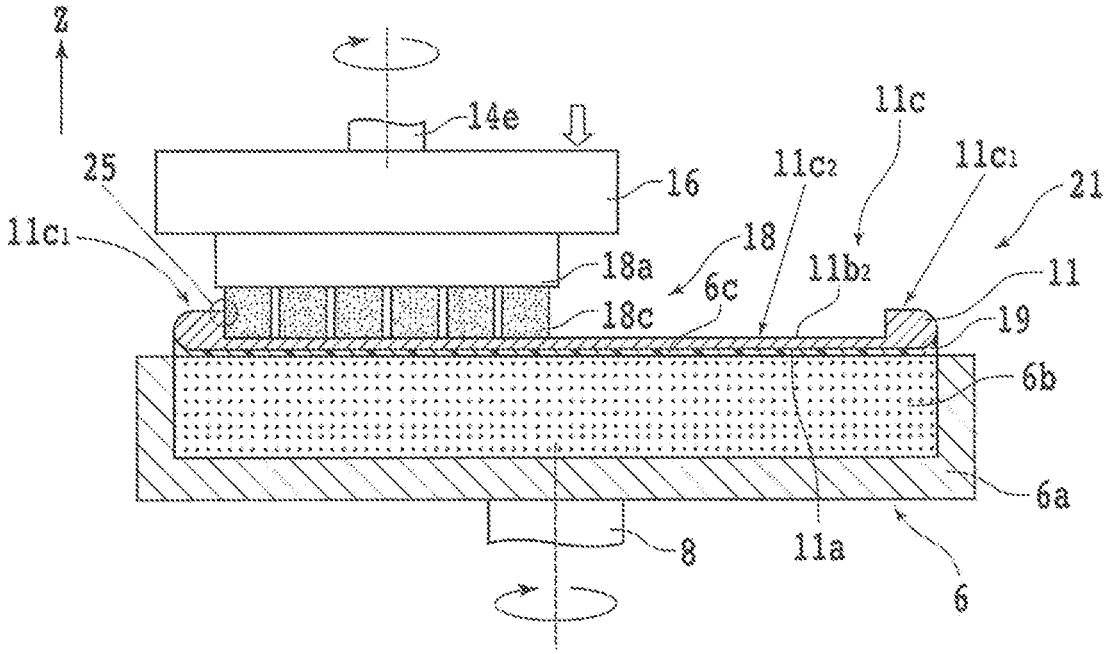
FIG. 8 is a side elevational view, partly in cross section, illustrating a grinding step according to a comparative example.

A comparative example will be described below. FIG. 8 is a side elevational view, partly in cross section, illustrating a grinding step according to the comparative example. According to the comparative example, after the face side protecting step S10 and the holding step S20, the spindle 14*e* is oriented parallel to the output shaft 8, and then the spindle 14*e* and the output shaft 8 are rotated respectively about their central axes, and the grinding unit 14 grinds the reverse side 11*b* of the workpiece 11. In this case, the outer side surfaces of the grindstones 18*c* are held in contact with the inner circumferential edge of the upper surface of the ring-shaped stiffening portion $\mathbf{11}c_1$ as illustrated by a region 25 indicated by a dot-and-dash-line circle in FIG. 8. Consequently, more chippings are likely to be produced on the reverse side 11*b* of the ring-shaped stiffening portion $\mathbf{11}c_1$, compared with the embodiment described above.

The structure, process, and other details according to the present embodiment may be changed or modified within the scope of the present invention. For example, the grinding method according to the present embodiment is applicable to both rough grinding and finishing grinding.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding method of grinding a reverse side of a disk-shaped workpiece having on a face side thereof a device region where a plurality of devices are formed and an outer circumferential surplus region surrounding the device region, with a grinding stone part of a grinding wheel having an annular wheel base, the grinding stone part being disposed in an annular pattern on a surface of the wheel base, comprising:

a face side protecting step of covering the face side of the workpiece with a protective member;

a holding step of holding the face side of the workpiece under suction on a disk-shaped chuck table that is rotatable about a central axis of a first rotational shaft;

after the holding step, an oblique grinding step of rotating the grinding wheel about the central axis of a second rotational shaft, the grinding wheel being mounted on a lower end of the second rotational shaft, having a diameter smaller than the diameter of the chuck table, and disposed above the chuck table, tilting the second rotational shaft with respect to the first rotational shaft such that a bottom of a first portion of the grinding wheel that is positioned above an outer circumferential portion of the chuck table is higher than the bottom of a second portion of the grinding wheel that is positioned above a central portion of the chuck table, and then moving the grinding wheel and the chuck table relatively to each other to bring the grinding wheel and the chuck table closer to each other along a direction parallel to the first rotational shaft, thereby forming a disk-shaped recess in the reverse side of the workpiece by grinding a central portion of the reverse side of the workpiece that corresponds to the device region thicknesswise across the workpiece, the disk-shaped recess being defined by a circular ground portion and a ring-shaped stiffening portion surrounding the circular ground portion and left unground; and after the oblique grinding step, a tilt changing and grinding step of grinding the reverse side of the workpiece while gradually changing a tilt of the second rotational shaft to orient the second rotational shaft parallel to the first rotational shaft.

2. The grinding method according to claim 1, further comprising:

after the tilt changing and grinding step, an ordinary grinding step of orienting the second rotational shaft of the grinding wheel and the first rotational shaft of the chuck table parallel to each other and then moving the grinding wheel and the chuck table relatively to each other to bring the grinding wheel and the chuck table closer to each other along the direction parallel to the first rotational shaft, thereby grinding the circular ground portion.

* * * * *